United States Patent [19]

Kucheck et al.

[11] 4,255,220

[45] Mar. 10, 1981

[54] METHOD FOR SUPPLYING A LABEL TO AN ARTICLE SURFACE

[75] Inventors: Leo Kucheck, Irvine; Michael Crankshaw, Santa Fe Springs, both of Calif.

[73] Assignee: Label-Aire Inc., Fullerton, Calif.

[21] Appl. No.: 9,276

[22] Filed: Feb. 2, 1979

[51] Int. Cl.[3] ..... B65C 9/18; B65C 9/28

[52] U.S. Cl. ..... 156/285; 156/249; 156/344; 156/361; 156/364; 156/497; 156/542; 156/DIG. 33; 156/DIG. 38

[58] Field of Search ..... 156/497, 542, 541, 584, 156/DIG. 33, DIG. 38, 249, 247, 285, 344, 364, 361, 571, 572

[56] References Cited

U.S. PATENT DOCUMENTS

| | | | |
|---|---|---|---|
| 3,025,211 | 3/1962 | Winn | 156/542 |
| 3,250,278 | 5/1966 | Rudszinat et al. | 156/568 |
| 3,329,550 | 7/1967 | Kucheck | 156/584 |
| 3,450,590 | 6/1969 | LaMers | 156/584 |
| 3,483,059 | 12/1969 | Dinter | 156/542 |
| 3,729,362 | 4/1973 | French et al. | 156/542 |
| 3,907,626 | 9/1975 | Cook | 156/361 |
| 3,910,811 | 10/1975 | Paxton et al. | 156/521 |
| 4,025,382 | 5/1977 | Del Rosso | 156/542 X |
| 4,026,755 | 5/1977 | Gossie | 156/285 |
| 4,046,613 | 9/1977 | Kucheck et al. | 156/285 |
| 4,132,583 | 1/1979 | Hodgson | 156/542 X |

*Primary Examiner*—Michael G. Wityshyn
*Attorney, Agent, or Firm*—Gordon L. Peterson

[57] ABSTRACT

A label applicator comprising a supporting structure and a label receiver mounted on the supporting structure for movement between a retracted position and an extended position. A label dispenser supplies a label to the label receiver when the label receiver is in the retracted position. The label is releasably retained on the label receiver. The label receiver is then moved to the extended position where the label is transferred by an air blast from the label receiver to an article.

6 Claims, 3 Drawing Figures

Fig. 2
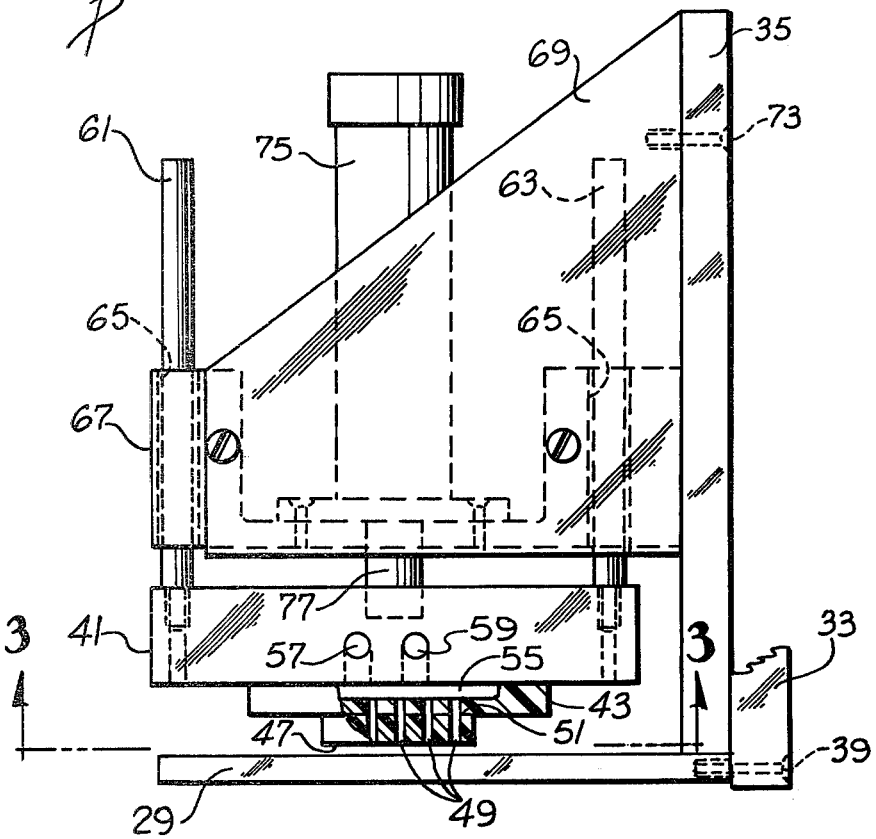
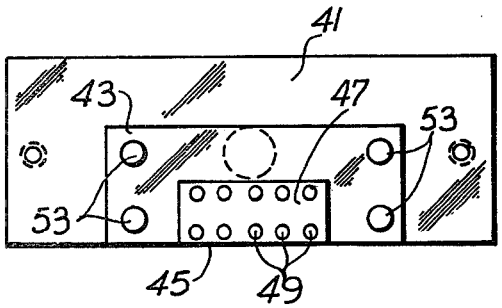
Fig. 3

METHOD FOR SUPPLYING A LABEL TO AN ARTICLE SURFACE

BACKGROUND OF THE INVENTION

In a typical conventional label applicator, a label having one face coated with a pressure sensitive adhesive is removed from a backing strip or web and supplied to a grid. The label is retained against the grid by vacuum pressure applied to the inner face of the grid. When an article to be labeled reaches an appropriate position at the labeling station, a blast of gas, such as air, transfers the label from the grid to the article, and the pressure sensitive adhesive adheres the label to the article.

The typical conventional label applicator as described above is dependable and most satisfactory for many labeling operations. However, the labeling of articles with relatively small labels introduces special problems. For example, small labels are difficult for the equipment to handle. In addition, it has been found that small labels cannot be blown by an air blast for relatively large distances because small labels are not stable in flight over long flight paths from the grid to the article to be labeled. It is not possible to convey the articles to be labeled past the grid in close enough proximity to the grid to avoid a long flight path for the labels because other components of the label applicator, such as the peeler bar, obstruct such a close-proximity path.

SUMMARY OF THE INVENTION

This invention provides a novel label applicator which substantially reduces the flight path of a label in being transferred from the label applicator to the article to be labeled. As such, the label applicator of this invention is particularly adapted for use with small labels, although its use is not limited to small labels. The label applicator of this invention also has considerable utility in applying labels to relatively inaccessible areas, such as within recesses in an article.

This invention utilizes a label receiver which includes means for releasably retaining a label on the label receiver. To reduce the flight path of the label, the label receiver is mounted for movement on a supporting structure between a retracted position and an extended position. Label dispensing means supplies a label to the label receiver when the label receiver is in the retracted position. The label receiver is then moved to the extended position so that the label on the label receiver will be in close proximity to the article to be labeled. Means is provided on the label receiver for transmitting a blast of a gas, such as air, to the label on the label receiver when the label receiver is in the extended position to transfer the label on the label receiver to the article. The label receiver is then moved to the retracted position where it receives a second label from the label dispensing means, and the sequence described above is then repeated.

Movement of the label receiver to the extended position reduces the flight path of the label. In addition, the movement of the label receiver can be used to move the label to a relatively inaccessible area for application to an article.

The label receiver translates in moving between the extended and retracted positions, although some rotary motion of the label receiver can also be provided, if desired. In a preferred construction, the label receiver moves along a straight, linear path in moving between the extended and retracted positions. Such an arrangement is of relatively simple construction and is inexpensive. In addition, an inexpensive linear actuator can be used to move the label receiver in one or both directions along the linear path.

To adapt the label receiver to applying labels within a recess, the label receiver preferably includes a first section and a nose section of reduced cross-sectional area projecting from the first section. The nose section is sized and adapted to be at least partially received in a recess in the article to be labeled. For applications in which the label is not to be applied within a recess, the nose section need not be of reduced cross-sectional area.

The means for releasably retaining the labels on the label receiver can advantageously include means for applying a reduced pressure to one face of the label receiver, and such means may include ports or passages in the label receiver. The passages in the label receiver can be coupled to a vacuum source, such as a vacuum pump.

Any suitable mechanism for repetitively supplying labels to the label receiver can be used. In a preferred construction, the labels are pressure sensitive and are supplied on an elongated backing strip. In this event, the label dispensing means can advantageously include a peeler bar adjacent the label receiver in the retracted position and means for moving the backing strip over the peeler bar to remove labels from the backing strip and supply them to the label receiver.

The label receiver can be of simple construction and may include, for example, a mounting block and the nose section. The nose section can advantageously take the form of a plate having a series of air passages therein which communicate with sources of air under pressure and vacuum pressure. The nose section may have an integral flange for attaching the nose section to the mounting block and a face for receiving the label from the label dispensing means of low-friction material to facilitate sliding of the label onto such face.

The mounting block can advantageously be mounted on the supporting structure for movement by one or more guide rods. This enables the label receiver to be reciprocated between the extended and retracted positions by the linear actuator.

The label applicator is preferably controlled automatically by control means. For labeling within a recess, the control means preferably holds the label receiver in the retracted position with a label retained on the label receiver. The control means includes a sensor responsive to the presence of an article at a predetermined location for causing, in sequence, the movement of the label receiver to the extended position, the transfer of the label from the label receiver to the article, the return of the label receiver to the retracted position and the dispensing of another label onto the label receiver.

BRIEF DESCRIPTION OF THE DRAWINGS

FIG. 2 is a front elevational view of the label applicator.

FIG. 3 is a bottom plan view of the label receiver taken generally along line 3—3 of FIG. 2.

DESCRIPTION OF THE PREFERRED EMBODIMENT

Figure 1:
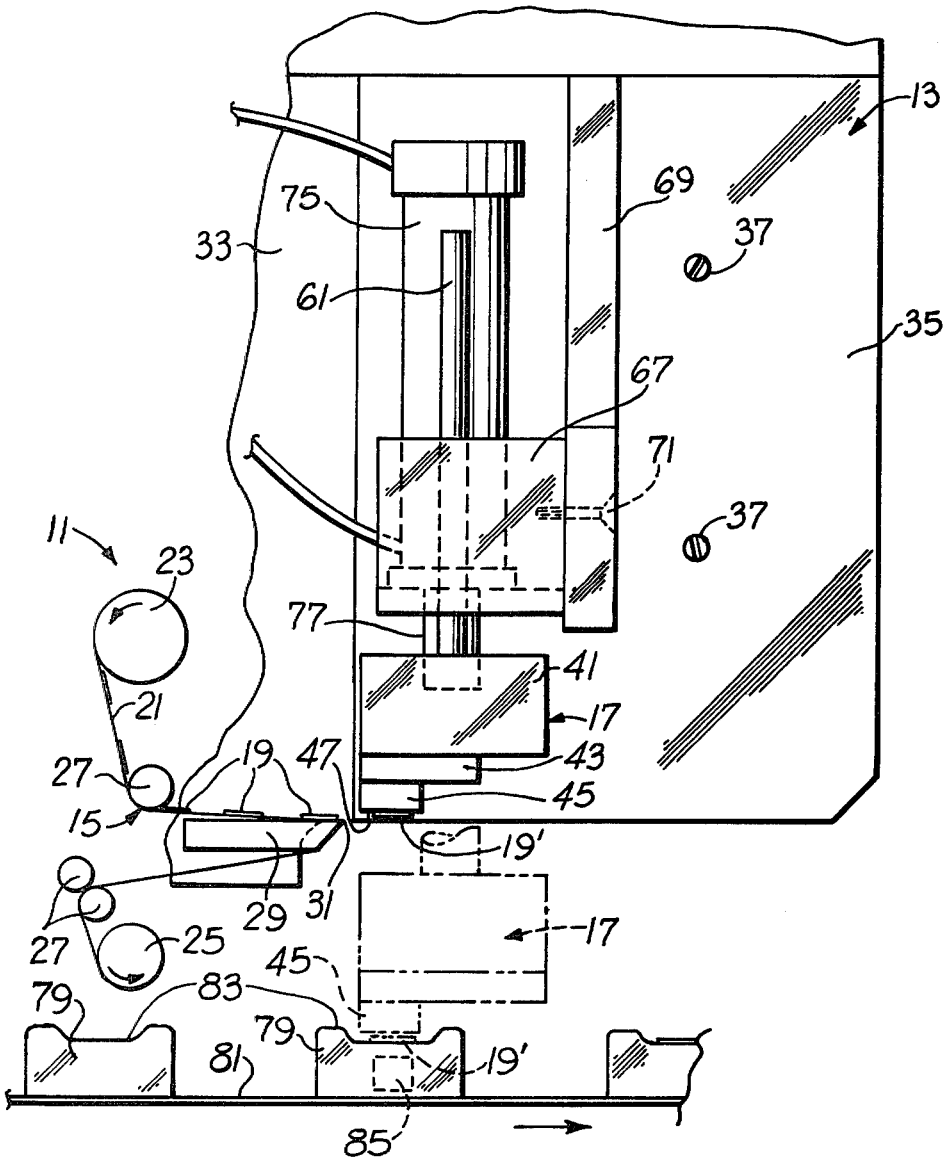
FIG. 1 is a side elevational view of a label applicator constructed in accordance with the teachings of this invention with portions of the applicator being shown schematically. The retracted position of the label receiver is shown in full lines and the extended position is shown in phantom lines.

FIG. 1 shows a label applicator 11 which includes a supporting structure 13, label dispensing means 15 mounted on the supporting structure and a label receiver 17. Although the label dispensing means 15 can be of various different kinds, in the embodiment illustrated, the label dispensing means is adapted for use with pressure sensitive adhesive lables 19 carried by an elongated backing strip or web 21. The label dispensing means 15 includes a supply reel 23 on which a supply of the labels 19 is wound, a take-up reel 25, a suitable number and arrangement of intermediate rollers 27 and a peeler bar 29. One of the rollers 27 is intermittently driven by a motor (not shown) to intermittently move the backing strip 21 from the supply reel 23 over a peeling edge 31 of the peeler bar to the take-up reel 25. This sequentially removes the labels 19 from the backing strip 21 and supplies them to the label receiver 17. This form of label dispensing means is conventional and, for this reason, is not shown or described in detail herein.

The illustrated portion of the supporting structure 13 includes a support plate 33 and a mounting plate 35 suitably attached as by screws 37 to the support plate. The peeler bar 29 can be attached to the support plate 33 by one or more screws 39 (FIG. 2).

Although the label receiver 17 can take different forms, in the embodiment illustrated, it includes a mounting block 41 of suitable material, such as metal, and a nose or nose section 45 of reduced cross-sectional area and projecting from the mounting block. The nose section 45 has an integral flange 43 which is removably attached to the mounting block by screws 53 (FIG. 3). In the embodiment illustrated, the nose section 45 is in the form of a block having an outer label-receiving face 47 and a plurality of air passages 49 (FIG. 3) extending completely through the block from the outer face 47 to an inner face 51. The outer face 47 is smooth, planar, has low friction and is adapted to receive the labels 19. To give the face 47 a low friction or slippery characteristic, the nose section 45 is preferably constructed of a low-friction plastic material, such as polytetrafluoroethylene. As shown in FIG. 1, a label 19' is releasably retained on the outer face 47.

The flange 43 is in the form of a thin plate. The flange 43 has a chamber or manifold passage 55 leading to the air passages 49.

The mounting block 41 has an air pressure port 59 and a vacuum port 57 which are adapted to be coupled, respectively, to sources (not shown) of air under pressure and air at less than atmospheric pressure. The ports 57 and 59 extend to the chamber 55 in the flange 43. Thus, the air passages 49 can be supplied with air under pressure from the port 59 and the chamber 55 and with air at vacuum pressure from the vacuum port 57 and the chamber 55. As best shown in FIG. 3, the mounting block 41 and the nose section 45 are of progressively decreasing area in plan view, have their lowermost edges (as viewed in FIG. 3) flush, and are centered or symmetrical about a central vertical axis (as viewed in FIG. 3).

The label receiver 17 is mounted for straight line reciprocating movement between a retracted position shown in full lines in FIG. 1 and an extended position shown in phantom lines in FIG. 1. Although the label receiver 17 can be mounted in different ways, in the embodiment illustrated, this is accomplished by a pair of parallel guide rods 61 and 63 which are suitably attached to the mounting block 41. The guide rods 61 and 63 are in turn slidably received within bearings 65 suitably retained within a bearing block 67. The bearing block 67 is suitably mounted on a bracket 69 as by screws 71, and the bracket 69 is in turn mounted on the mounting plate 35 (FIG. 2) as by screws 73.

The label receiver 17 can be moved between the extended and retracted positions in different ways, such as by a linear actuator 75. The actuator 75 in the embodiment illustrated is air operated and can be double acting or include a spring for movement of the label receiver 17 in one direction. The actuator 75 is suitably fixedly mounted on the bracket 69 and includes a connecting rod 77 which extends through the bearing block 67 and is suitably attached to a central region of the mounting block 41. The actuator 75 contains suitable stops (not shown) which define the extended and retracted positions of the label receiver 17.

The label applicator 11 is adapted to label articles 79 which are conveyed through a labeling station past the label applicator by a conveyor 81. Although various different kinds of articles can be labeled with the label applicator 11, each of the articles 79 has a recess 83 in its upper surface. In the retracted position, the label receiver 17 is relatively far away from the articles 79 that are conveyed through the labeling station. Moreover, it is not possible to adjust the location of the label applicator 11 to bring the articles into close proximity to the label receiver 17 in the retracted position due to the obstruction provided by other components of the label applicator, such as the peeler bar 29. However, by moving the label receiver 17 to the extended position shown in phantom lines in FIG. 1, the label receiver 17 and the label 19' carried thereby are brought into very close proximity to the article 79 to be labeled. In fact, the nose section 45 can be sized to be partially received in the recess 83 so that the flight path of the label 19' can be made very short.

The label applicator 11 can be controlled in different ways. For labeling within the recesses 83, the label applicator 11 preferably awaits one of the articles 79 with the label 19' on the label receiver 17 and with the label receiver in the retracted position. A sensor 85 shown schematically in FIG. 1 provides a signal when the leading article 79 on the conveyor 81 reaches a predetermined location at the labeling station. In response to the signal, air under pressure is supplied to the actuator 75 to extend the actuator and move the label receiver 17 to the extended position in which the nose section 45 is received within the recess 83. The movement of the label receiver 17 is properly timed relative to the advance of the articles 79 so that the nose section 45 can enter the recess 83. Immediately upon reaching the extended position, a blast of air under pressure is supplied through the port 59 and the passages 49 to blow the label 19' from the face 47 of the label receiver 17 and apply the label to the article within the recess 83. The actuator 75 then immediately retracts to return the label receiver 17 to the retracted position. This is carried out sufficiently rapidly so that the article 79 will not strike the nose section 45. As soon as the label receiver 17 is moved to the retracted position, the label dispensing means 15 automatically indexes to supply one additional label to the label receiver 17 whereupon the sequence described above is repeated. When labeling is not carried out within a recess, it may be advantageous to have the label receiver 17 in the extended position while it awaits the article to be labeled.

The proximity of the label receiver 17 to the article 79 in the extended position can be varied as desired. By way of example and not by way of limitation, for very small labels, it may be desirable to have the outer face 47 of the nose section 45 be 1/16 to 1/32 of an inch from the surface to which the label is to be applied.

Although an exemplary embodiment of the invention has been shown and described, many changes, modifications and substitutions may be made by one having ordinary skill in the art without necessarily departing from the spirit and scope of this invention.

We claim:

1. A method of applying a relatively small label to a surface of an article within a relatively small recess of the article comprising:

providing a label receiver with a nose section of reduced cross-sectional area and sized to be at least partially received in the recess of the article;

supplying a label to the nose section of the label receiver when the label receiver is in a first position;

releasably retaining the label on the nose section of the label receiver;

moving the label receiver from the first position to a label applying position in which the nose section of the label receiver is at least partially received within the recess of the article and in which the label is spaced from the surface; and applying a blast of a gas through the label receiver and against the label on the nose section of the label receiver to apply the label to the surface of the article within the recess.

2. A method as defined in claim 1 including sensing the position of the article and said step of moving includes moving the label receiver to the label applying position in response to the article reaching a predetermined position.

3. A method as defined in claim 1 wherein said step of moving includes moving the label receiver along a linear path between said first position and said label applying position.

4. A method for supplying a label to a surface of an article comprising:

moving the article to be labeled through a label applying station;

providing a label receiver having a label receiving face and passage means opening at said face;

supplying a label to a label receiving face of the label receiver when the label receiver is in a first position;

applying reduced pressure to the passage means of the label receiver which is sufficient to releasably retain the label on the label receiving face of the label receiver;

advancing the label receiver along a path from the first position toward the labeling station to a label applying position in which the label receiving face of the label receiver is spaced from the article as the article is moved through the label applying station, the label receiving face of the label receiver being substantially closer to the article in the label applying position than in the first position when the article is moved through the label applying station;

applying a blast of gas through the passage means of the label receiver and against the label on the label receiving face of the label receiver to remove the label from the label receiving face when the label receiver is in the extended position and to transfer the label to the surface of the article at the labeling station without pressing the label against the article with the label receiver; and returning the label receiver to the first position along said path whereby the label receiver moves in both directions along said path between said first position and said label applying position.

5. A method as defined in claim 4 wherein said path is linear.

6. A method as defined in claim 4 including sensing the position of the article and said step of advancing includes advancing the label receiver along said path to the label applying station in response to the article reaching a predetermined position.

* * * * *